United States Patent [19]

Sakakibara

[11] Patent Number: 5,063,955

[45] Date of Patent: Nov. 12, 1991

[54] METHOD OF DRIVING AN AUTOMATIC ON-OFF VALVE FOR A WATER PASSAGEWAY

[75] Inventor: Shigeru Sakakibara, Aichi, Japan

[73] Assignee: Inax Corporation, Tokoname, Japan

[21] Appl. No.: 547,213

[22] Filed: Jul. 3, 1990

[30] Foreign Application Priority Data

Aug. 25, 1989 [JP] Japan ..... 1-219568

[51] Int. Cl.[5] ..... F16K 31/02

[52] U.S. Cl. ..... 137/1; 251/129.04; 4/623

[58] Field of Search ..... 251/129.04; 4/623; 137/1

[56] References Cited

U.S. PATENT DOCUMENTS

| | | | |
|---|---|---|---|
| 3,333,160 | 7/1967 | Gorski | 251/129.04 X |
| 4,681,141 | 7/1987 | Wang | 137/625.4 X |
| 4,826,129 | 5/1989 | Fong et al. | 4/623 X |
| 4,886,207 | 12/1989 | Lee et al. | 251/129.04 X |

FOREIGN PATENT DOCUMENTS

| | | |
|---|---|---|
| 0225016 | 6/1987 | European Pat. Off. . |
| 0245577 | 11/1987 | European Pat. Off. . |
| 3629580 | 7/1987 | Fed. Rep. of Germany . |
| 1494302 | 7/1967 | France . |
| 61-48682 | 3/1986 | Japan . |

*Primary Examiner*—Arnold Rosenthal

*Attorney, Agent, or Firm*—Kanesaka and Takeuchi

[57] ABSTRACT

A method of driving an automatic on-off valve for a water passageway uses the automatic on-off valve including an electromagnetic valve for opening and closing the water passageway, a sensor unit for detecting an object such as a man or a human hand and a control unit for controlling supply/cut-off of driving electric power supplied from a power supply to the electromagnetic valve in response to a signal transmitted from the sensor unit. The method comprises the steps of: permitting the control unit to control an operation of the electromagnetic valve in a normal state; manually supplying the electromagnetic valve with the driving power given from a manual driving unit connected to the electromagnetic valve; and thus forcibly driving the electromagnetic valve.

3 Claims, 4 Drawing Sheets

METHOD OF DRIVING AN AUTOMATIC ON-OFF VALVE FOR A WATER PASSAGEWAY

FIELD OF THE INVENTION AND RELATED ART STATEMENT

The present invention is directed to a method of driving an automatic on-off valve for a water passageway in an automatic water washing equipment or an automatic wet scrubber of an urinal.

An arrangement of the automatic wet scrubber of the urinal is that an electromagnetic valve is disposed on the water passageway and operationally controlled by a control unit which receives a signal from a sensor.

This type of recently utilized automatic on-off valve for the water passageway tends to incorporate a battery as a power supply. The on-off valve having the battery power supply in general employs a latch type electromagnetic valve to reduce the electric power consumed to the greatest possible degree. The latch type electromagnetic valve is arranged in such a way that an electric current flows through a coil for excitation only when changing the valve from a closed state to an open state and vice versa; the coil ceases to be electrified after reaching the valve open or closed state; and thereafter the respective states are held by a latch mechanism including a permanent magnet and so on. The electric power is to be consumed only when operating the valve according to the thus constructed latch type electromagnetic valve which is also operable for a long period of time when the battery is utilized as a power supply.

There arise, however, some problems inherent in the above-mentioned electromagnetic valve in the automatic on-off valve, wherein a sealing portion between a valve seat and a valve body is fixed during a long preservation before being installed; and once the valve seat and the valve body are fixed together, the operation can not smoothly be performed when trying to actuate it after the illustration has been made. The automatic on-off valve which typically incorporates the battery as a power supply is arranged to supply minimum driving power needed for operating the valve with the intention of consuming an amount of electric power as small as possible when actuating the valve. If the valve seat is fixed to the valve body, however, it follows that the electromagnetic valve does not operate by a weak driving force.

An approach to such a situation is to replace the electromagnetic valve or to release the fixation between the valve seat and the valve body by decomposing the valve driving unit. The replacement of the electromagnetic valve, however, entails a futility of the product. On the other hand, the release of fixation thereof by decomposing the electromagnetic valve requires troublesome works for that purpose.

OBJECTS AND SUMMARY OF THE INVENTION

It is a primary object of the present invention, which obviates the foregoing problems incidental to the prior arts, to provide a method of driving an automatic on-off valve for a water passageway, which is capable of forcibly manually operating an electromagnetic valve when it does not work smoothly.

It is another object of the invention is to provide a method of driving an automatic on-off valve, which is capable of smoothly effecting a test for a passage of water.

To accomplish the objects given above, according to one aspect of the invention, there is provided a method of driving an automatic on-off valve for a water passageway, the automatic on-off valve including an electromagnetic valve for opening and closing the water passageway, a sensor unit for detecting an object such as a man or a human hand and a control unit for controlling supply or cut-off of driving electric power supplied from a power supply to the electromagnetic valve in response to a signal transmitted from the sensor unit, the method comprising the steps of: permitting the control unit to control an operation of the electromagnetic valve in a normal state; manually supplying the electromagnetic valve with the driving power given from a manual driving unit connected to the electromagnetic valve; and thus forcibly driving the electromagnetic valve.

According to the present invention, the electromagnetic valve is not only operated under control of the control unit by a driving force given from an original power supply but also driven by the manual driving unit.

In accordance with one embodiment of the invention, the control unit of the automatic on-off valve is connected via a connector to the electromagnetic valve. The electromagnetic valve is operated by the electric power imparted from the power supply like a battery under control of the control unit in a normal state. On the other hand, if the valve sealing portion is fixed enough to make the electromagnetic valve unable to smoothly operate, the connector is removed, and instead, the manual driving unit is connected to the electromagnetic valve. The manual driving unit supplies the electromagnetic valve with driving electric power larger than the normally supplied driving electric power; or alternatively, an electric power supplying time per pulse is increased. With this arrangement, the electromagnetic valve can forcibly be operated overcoming the fixing force of the valve sealing portion. Once the fixation of the valve sealing portion is thus released, the control unit is connected again to the electromagnetic valve by demounting the manual driving unit, and thereafter the electromagnetic valve can smoothly be operated by the electric power normally supplied from the original power supply such as a battery. Namely, the inoperable electromagnetic valve can smoothly be operated even when installing a multiplicity of automatic on-off valves in case the single driving unit is prepared.

Where the electromagnetic valve is made to word by employing the above-described manual driving unit, in addition to the advantages discussed above there is created an advantage of smoothly carrying out a test for a passage of water. More specifically, when performing the water passage test by automatically opening and closing the electromagnetic valve in response to a signal transmitted from a sensor, water is allowed to flow for a predetermined period (e.g., 5 seconds) and ceases to flow. It is therefore required that the operations of flowing and cutting off water be repeated while causing the sensor to detect the object many times. Whereas in the case of forcibly operating the electromagnetic valve by use of the manual driving unit, an advantage is produced, wherein water is allowed to continuously flow by manipulating a button.

Note that such an arrangement is given merely by way of one embodiment of the present invention, and the manual driving unit may be incorporated for every automatic on-off valve.

BRIEF DESCRIPTION OF THE DRAWINGS

Other objects and advantages of the present invention will become apparent during the following discussion taken in conjunction with the accompanying drawings, in which.

DESCRIPTION OF THE PREFERRED EMBODIMENTS

Embodiments where the present invention is applied to an automatic wet scrubber of an urinal will hereinafter be described in detail.

Figure 2:
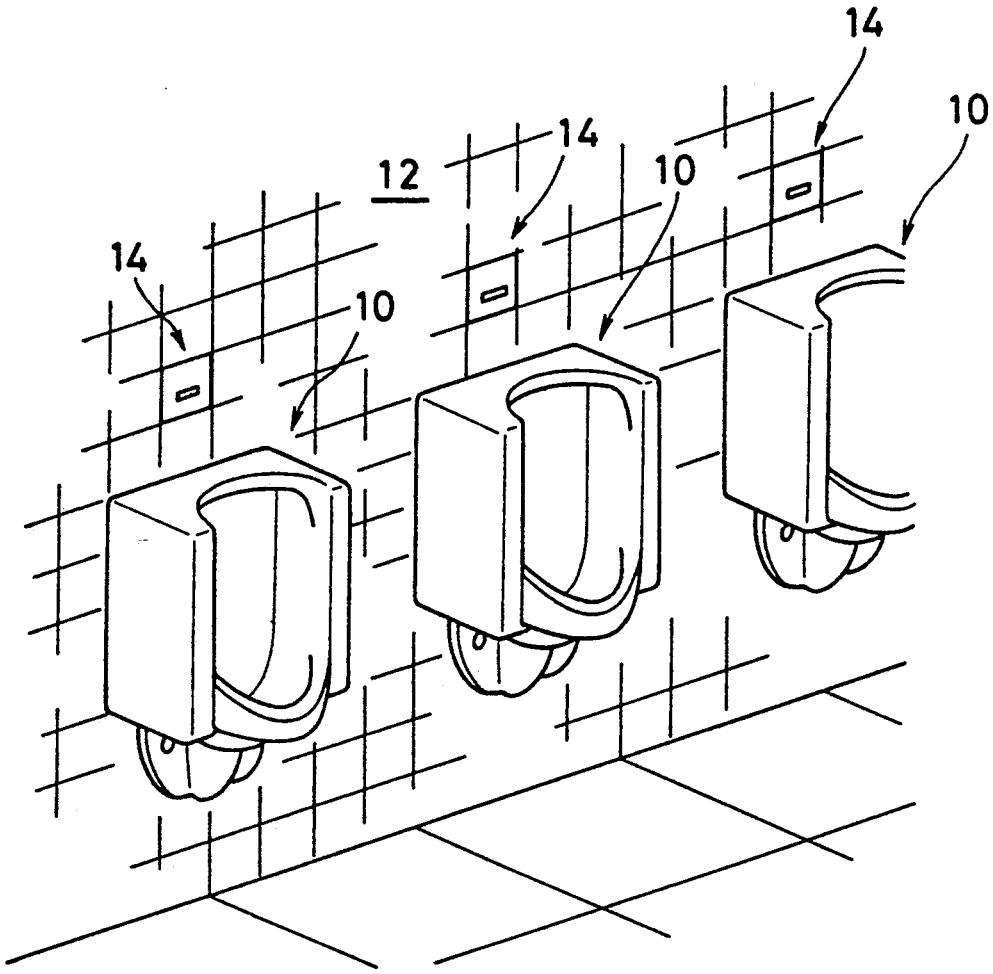
FIG. 2 is a perspective view illustrating urinals each including the water passageway with automatic on-off valve depicted in FIG. 1 and principal portions peripheral thereto.

Turning first to FIG. 2, numeral 10 represents an urinal fitted to a fitting wall surface 12 which incorporates an automatic on-off valve 14 for opening and closing a passageway for washing water.

Figure 3A:
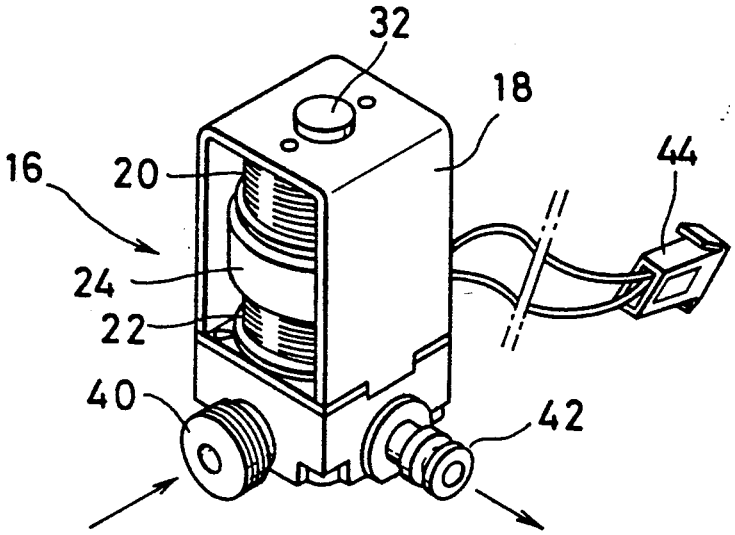
FIG. 3A is a perspective view illustrating a configuration of an electromagnetic valve in the automatic on-off valve.
Figure 3B:
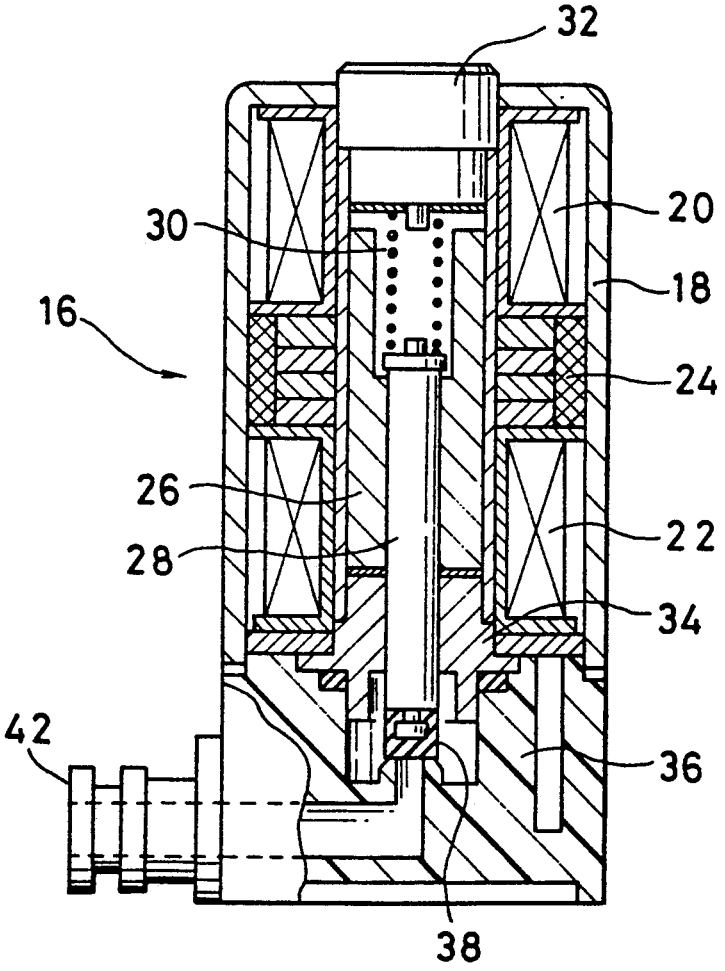
FIG. 3B is a sectional view thereof.

The automatic on-off valve 14 includes a latch type electromagnetic valve 16 (FIGS. 3A and 3B). The electromagnetic valve 16 is composed of: a frame 18, coils 20 and 22 each wound in an opposite direction; a permanent magnet 24 interposed between the coils 21 and 22; a plunger 26 made of a magnetic material and disposed at the center of the coils 20 and 22; a rod 28 inserted into a central hole of the plunger 26; a spring 30 for biasing the rod 28 in such a direction as to open the valve; cores 32 and 34 disposed at both ends of the plunger 26; a resinous valve body 36; and a rubber valve head 38 attached to a top of the rod 28. The thus constructed electromagnetic valve 16 is arranged such that when an electric current acting in such a direction as to attract the plunger 26 flows in the coil 20, an electric current acting in such a direction as to offset a magnetic force of the permanent magnet 24 flows in the other coil 22, as a result of which the plunger 26 is pulled upwards in the Figure and is thereby adsorbed to the core 32. The plunger 26 adsorbed to the core 32 is held in this state by the magnetic force of the permanent magnet 24 even after stopping the electrification of the coils 20 and 22, thus keeping a valve-open state. With this arrangement, a communication between an inflow port 40 and an outflow port 42 for the washing water is held, thereby supplying the washing water to urinals 10.

While on the other hand, when a voltage is applied in a direction opposite to the previous one, the current acting in such a direction as to attract the plunger 26 flows in the coil 22. Whereas the coil 20 receives the current acting in such a direction as to offset the magnetic force of the permanent magnet 24. In consequence of this, the plunger 26 is pulled downwards in the Figure and is thereby adsorbed to the core 34. The plunger adsorbed to the core 34 remains as it is by dint of the magnetic force of the permanent magnet 24 even after stopping the electrification of the coils 20 and 22. At this moment, the rod 28 is depressed downwards in the Figure by the biasing force given from the spring 30, with the result that the rubber valve head 38 attached to a head of the rod 28 is pushed against a resinous valve seat to thereby close a water passageway, and this state is kept.

Figure 1A:
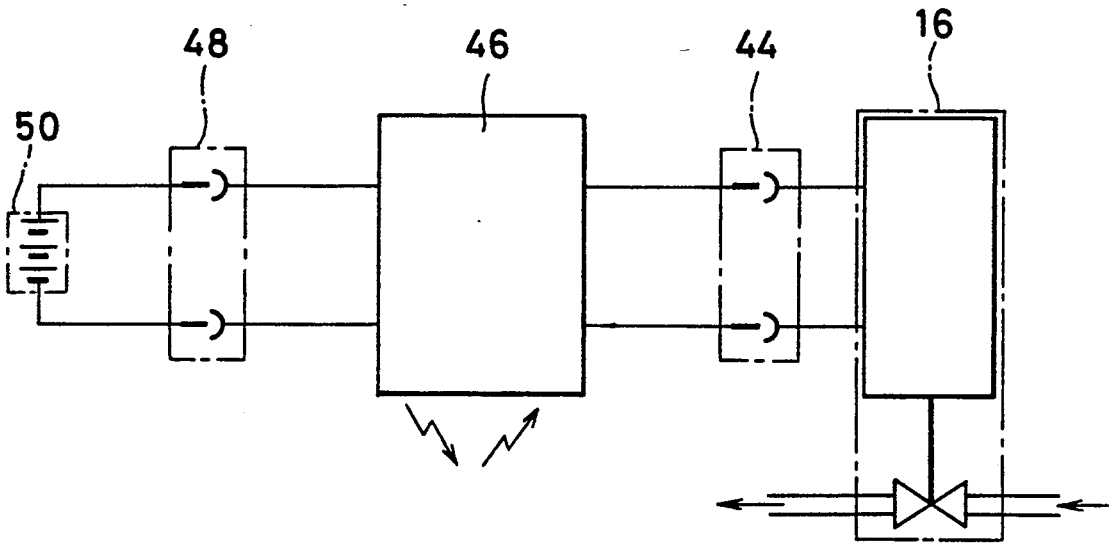
FIGS. 1A and 1B are diagrams of assistance in explaining a method of driving an automatic on-off valve for a water passageway, showing one embodiment of the present invention.

FIG. 1A is a block diagram depicting a configuration of the automatic on-off valve including the electromagnetic valve 16. Designated at 46 in the Figure is a sensor/control unit connected via a connector 44 to the electromagnetic valve 16. A battery power supply 50 is connected via a connector 48 to the sensor/control unit 46.

According to the automatic on-off valve, the sensor detects a man standing in front of the urinal 10. In response to a detecting signal thereof the control unit works to apply voltages given from the power supply which are conceived as pulse voltages to the coils 20 and 22 of the electromagnetic valve 16 for a predetermined period, thereby opening the electromagnetic valve 16. The pulse voltage and the application period on this occasion are set to minimum vales necessary for operating the electromagnetic valve 16. For instance, as shown in FIG. 4(A), a voltage of 4.0 V is impressed for 20 msec.

The thus opened electromagnetic valve 16 holds this state by itself and remains as it is, whereby the washing water continues to flow for a predetermined period (e.g., 5 seconds). After the preset period has passed, the voltage acting in the direction opposite to the above-mentioned is applied for a time in response to a signal transmitted from a timer, thereby closing the electromagnetic valve 16 to cut off the supply of the washing water.

Figure 1B:
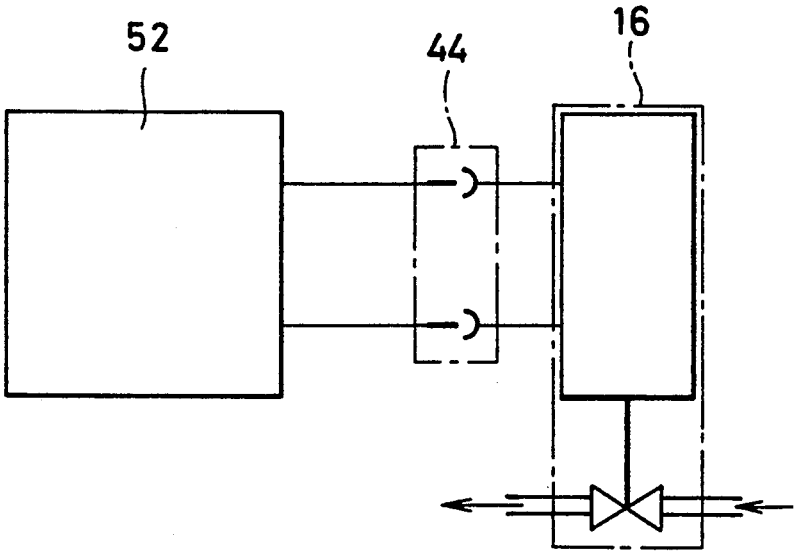
Figure 4:
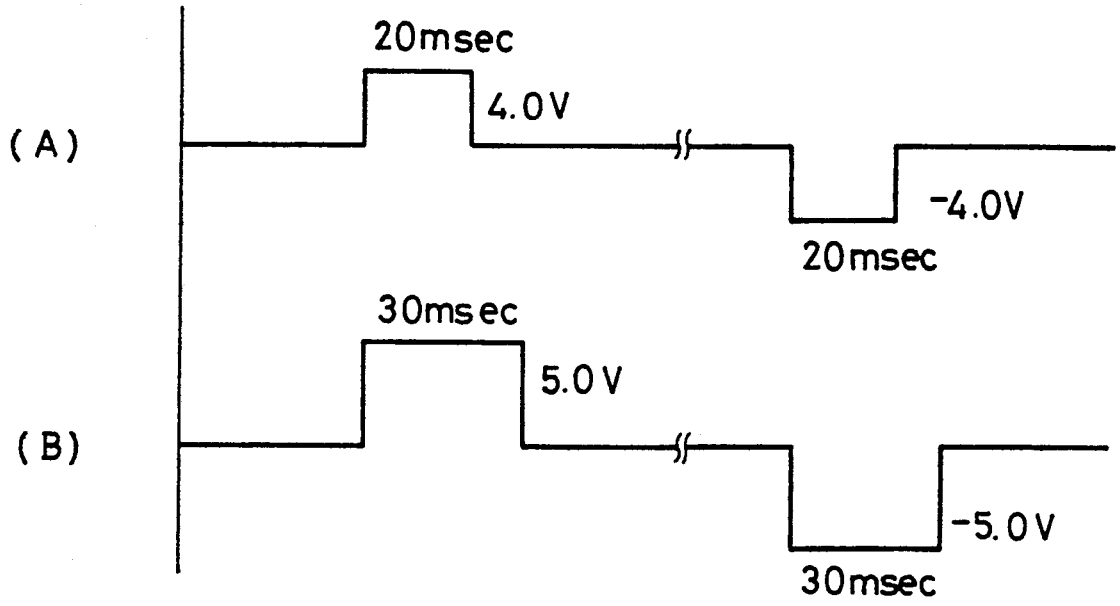
FIG. 4 is a chart showing patterns on which driving electric power is supplied to the electromagnetic valve.

If the electromagnetic valve does not function as in the way described above, namely electromagnetic valve 16 does not operate by the foregoing driving force because of fixing the rubber valve head 38 to the valve body 36 of the electromagnetic valve 16 when installing the automatic on-off valve, according to the method of the present invention the manual driving unit 52 is, as illustrated in FIG. 1B, connected via a connector 44 to the electromagnetic valve 16 which is then supplied with a driving force larger than before from the manual driving unit 52 for a long period of time (as shown in FIG. 4(B), a voltage of 5 V is applied for 30 msec). Accordingly the fixation is released instead of replacing or decomposing the electromagnetic valve 16 according to the prior art.

The fixation of the valve head 38 to the valve seat is thus released, whereby the electromagnetic valve 16 can forcibly be operated. Once the fixation is released, the electromagnetic valve 16 is thereafter operated by the normal driving force. Then, after demounting the manual driving unit 52, the sensor/control unit 46 may be again connected via the connector 44 to the electromagnetic valve 16.

Although the illustrative embodiments of the present invention have been described in detail, it is to be understood that the present invention is, as explained earlier, applicable to an automatic water washing equipment as well as to the on-off valve for the water passageway in the automatic wet scrubber of the urinal. Besides, the present invention is applicable to the automatic on-off valve which utilizes not only the battery power supply but also an AC power supply. The present invention can be practiced in embodiments where a variety of modifications are to be effected within a range which does not depart from the gist of the invention.

What is claimed is:

1. A method of driving an automatic on-off valve for a water passageway, said automatic on-off valve including an electromagnetic valve for opening and closing said water passageway, a sensor unit for detecting an object and a control unit for controlling supply/cut-off of driving electric power supplied from a power supply to said electromagnetic valve in response to a signal transmitted from said sensor unit, said method comprising the steps of:

permitting said control unit to control an operation of said electromagnetic valve in a normal state;

connecting a manual driving unit to said electromagnetic valve;

manually supplying said electromagnetic valve with driving power given from the manual driving unit, said driving power from the manual driving unit being in the form of pulses and having a pulse continuity time longer than that of the driving electric power supplied through the control unit; and thus forcibly driving said electromagnetic valve.

2. The driving method as set forth in claim 1, wherein said manual driving unit is of a portable type.

3. The driving method as set forth in claim 1, wherein said electromagnetic valve is of a latching type.

* * * * *